US008978197B2

(12) United States Patent
Kang

(10) Patent No.: US 8,978,197 B2
(45) Date of Patent: Mar. 17, 2015

(54) VACUUM CLEANER

(75) Inventor: Sung Su Kang, Changwon (KR)

(73) Assignee: LG Electronics Inc., Seoul (KR)

( * ) Notice: Subject to any disclaimer, the term of this patent is extended or adjusted under 35 U.S.C. 154(b) by 985 days.

(21) Appl. No.: 12/720,115

(22) Filed: Mar. 9, 2010

(65) Prior Publication Data

US 2010/0229331 A1 Sep. 16, 2010

Related U.S. Application Data

(60) Provisional application No. 61/160,035, filed on Mar. 13, 2009.

(51) Int. Cl.
*A47L 9/10* (2006.01)

(52) U.S. Cl.
CPC ..... *A47L 9/108* (2013.01)
USPC ..... 15/347

(58) Field of Classification Search
CPC ..... A47L 9/108
USPC ..... 15/347, 348, 353; 55/423, 428
See application file for complete search history.

(56) References Cited

U.S. PATENT DOCUMENTS

| | | | | |
|---|---|---|---|---|
| 83,469 | A | 10/1868 | Crandall | |
| 2,283,836 | A | 5/1942 | White | 183/38 |
| 2,714,426 | A | 8/1955 | White | 183/58 |
| 3,367,462 | A | 2/1968 | Bibbens | 192/55 |
| 4,379,385 | A | 4/1983 | Reinhall | 56/16.6 |
| 4,545,794 | A | 10/1985 | Himukai | 55/362 |
| 4,601,082 | A | 7/1986 | Kurz | 15/319 |
| 4,617,034 | A | 10/1986 | Ikezaki et al. | 55/276 |
| 4,809,394 | A | 3/1989 | Suka et al. | 15/327 |
| 5,013,343 | A * | 5/1991 | Miyamoto | 55/395 |
| 5,033,151 | A | 7/1991 | Kraft et al. | 15/319 |
| 5,135,552 | A | 8/1992 | Weistra | 55/337 |
| 5,159,738 | A | 11/1992 | Sunagawa et al. | 15/326 |
| 5,233,682 | A | 8/1993 | Abe et al. | 395/61 |
| 5,251,358 | A | 10/1993 | Moro et al. | 15/319 |
| 5,265,305 | A | 11/1993 | Kraft et al. | 15/319 |
| 5,323,483 | A | 6/1994 | Baeg | 288/811 |
| 5,542,146 | A | 8/1996 | Hoekstra et al. | 15/319 |
| 6,192,550 | B1 | 2/2001 | Hamada et al. | |
| 6,290,752 | B1 * | 9/2001 | Koller et al. | 95/107 |

(Continued)

FOREIGN PATENT DOCUMENTS

| | | |
|---|---|---|
| AU | 2005229774 A1 | 8/2006 |
| AU | 2007200406 B2 | 9/2007 |

(Continued)

OTHER PUBLICATIONS

U.S. Office Action issued in U.S. Appl. No. 12/407,983 dated Jun. 21, 2011.

(Continued)

*Primary Examiner* — Lee D Wilson
*Assistant Examiner* — Henry Hong
(74) *Attorney, Agent, or Firm* — Ked & Associates, LLP

(57) ABSTRACT

A vacuum cleaner is provided. The vacuum cleaner may include a main body, a dust separator selectively mounted on the main body, the dust separator including a dust separation device and a dust storage device having at least one compression member disposed therein, the at least one compression member being configured to be rotated to compress dust.

8 Claims, 20 Drawing Sheets

(56) References Cited

U.S. PATENT DOCUMENTS

| | | | | |
|---|---|---|---|---|
| 6,460,217 | B2 | 10/2002 | Fukushima et al. | 15/346 |
| 6,572,668 | B1 | 6/2003 | An et al. | |
| 6,589,306 | B2 | 7/2003 | Ronning et al. | |
| 6,625,845 | B2 | 9/2003 | Hayashi et al. | 15/353 |
| 6,689,225 | B2 | 2/2004 | Illingworth | 134/21 |
| 6,694,917 | B1 | 2/2004 | Wang | 119/51.11 |
| 6,735,816 | B2 | 5/2004 | Oh et al. | 15/353 |
| 6,757,933 | B2 | 7/2004 | Oh et al. | 15/353 |
| 6,779,229 | B2 | 8/2004 | Lee et al. | 15/329 |
| 6,782,584 | B2 * | 8/2004 | Choi | 15/352 |
| 6,922,868 | B1 | 8/2005 | Jeong | 15/353 |
| 7,028,369 | B2 | 4/2006 | Park et al. | 15/353 |
| 7,152,276 | B2 | 12/2006 | Jin et al. | 15/352 |
| 7,160,347 | B2 | 1/2007 | David et al. | |
| 7,171,725 | B2 * | 2/2007 | Sjoberg et al. | 15/348 |
| 7,351,269 | B2 | 4/2008 | Yau | 55/297 |
| 7,475,449 | B2 | 1/2009 | Lee | 15/326 |
| 7,481,868 | B2 | 1/2009 | Lee et al. | 95/273 |
| 7,547,340 | B2 | 6/2009 | Park | 55/429 |
| 7,582,128 | B2 | 9/2009 | Hwang et al. | 55/337 |
| 7,601,188 | B2 | 10/2009 | Hwang et al. | 55/343 |
| 7,608,123 | B2 | 10/2009 | Pineschi | 55/429 |
| 7,640,625 | B2 | 1/2010 | Oh et al. | 15/352 |
| 7,644,469 | B2 | 1/2010 | Beers et al. | 15/319 |
| 7,647,672 | B2 | 1/2010 | Nam et al. | 15/352 |
| 7,704,290 | B2 | 4/2010 | Oh | 55/295 |
| 7,749,295 | B2 | 7/2010 | Hwang et al. | 55/428 |
| 7,770,253 | B2 | 8/2010 | Ha et al. | 15/319 |
| 7,785,381 | B2 | 8/2010 | Oh et al. | 55/300 |
| 7,785,396 | B2 | 8/2010 | Hwang et al. | 95/1 |
| 7,854,782 | B2 | 12/2010 | Oh et al. | 55/429 |
| 7,951,216 | B2 | 5/2011 | Ha et al. | |
| 7,958,598 | B2 | 6/2011 | Yun et al. | |
| 2001/0025395 | A1 | 10/2001 | Matsumoto et al. | 15/353 |
| 2002/0073505 | A1 | 6/2002 | Bolden | 15/340.1 |
| 2002/0088079 | A1 | 7/2002 | Oh | 15/352 |
| 2002/0124538 | A1 | 9/2002 | Oh et al. | 55/426 |
| 2004/0211025 | A1 | 10/2004 | Jung et al. | 15/353 |
| 2004/0261216 | A1 | 12/2004 | Choi et al. | 15/352 |
| 2005/0091787 | A1 | 5/2005 | Bair et al. | 15/353 |
| 2005/0125943 | A1 * | 6/2005 | Sjoberg et al. | 15/404 |
| 2005/0138763 | A1 | 6/2005 | Tanner et al. | 15/353 |
| 2005/0172584 | A1 | 8/2005 | Oh et al. | 55/345 |
| 2005/0252179 | A1 | 11/2005 | Oh et al. | 55/337 |
| 2006/0048491 | A1 * | 3/2006 | Pineschi | 55/428 |
| 2006/0123750 | A1 * | 6/2006 | Lee et al. | 55/428 |
| 2007/0136980 | A1 | 6/2007 | Fujiwara et al. | 15/339 |
| 2007/0143953 | A1 | 6/2007 | Hwang et al. | 15/353 |
| 2007/0209149 | A1 | 9/2007 | Lee | 15/352 |
| 2007/0209339 | A1 | 9/2007 | Conrad | 55/345 |
| 2008/0023035 | A1 | 1/2008 | Ha et al. | 134/18 |
| 2008/0023036 | A1 * | 1/2008 | Ha et al. | 134/21 |
| 2008/0047094 | A1 | 2/2008 | Ha et al. | 15/347 |
| 2008/0052870 | A1 | 3/2008 | Lee et al. | 15/350 |
| 2008/0172824 | A1 | 7/2008 | Yun et al. | 15/352 |
| 2008/0172993 | A1 | 7/2008 | Yun et al. | 55/337 |
| 2008/0263816 | A1 | 10/2008 | Oh et al. | 15/347 |
| 2008/0264007 | A1 | 10/2008 | Oh et al. | 55/304 |
| 2008/0264014 | A1 * | 10/2008 | Oh et al. | 55/423 |
| 2008/0264015 | A1 * | 10/2008 | Oh et al. | 55/429 |
| 2008/0264016 | A1 | 10/2008 | Oh et al. | 55/429 |
| 2009/0178231 | A1 | 7/2009 | Hwang et al. | 15/347 |
| 2009/0178235 | A1 | 7/2009 | Yun et al. | 15/352 |
| 2009/0178236 | A1 | 7/2009 | Yun et al. | 15/352 |
| 2009/0229072 | A1 | 9/2009 | Hwang et al. | 15/352 |
| 2009/0229073 | A1 | 9/2009 | Hwang et al. | 15/352 |
| 2009/0235956 | A1 | 9/2009 | Hwang et al. | 134/21 |
| 2009/0241286 | A1 | 10/2009 | Hwang et al. | 15/347 |
| 2009/0249578 | A1 | 10/2009 | Hwang et al. | 15/352 |
| 2009/0255083 | A1 | 10/2009 | Hwang et al. | 15/347 |
| 2009/0266382 | A1 | 10/2009 | Hwang et al. | 134/21 |
| 2009/0293221 | A1 | 12/2009 | Hwang et al. | 15/347 |
| 2009/0293223 | A1 | 12/2009 | Hwang et al. | 15/352 |
| 2009/0293224 | A1 | 12/2009 | Hyun et al. | 15/353 |
| 2009/0293915 | A1 | 12/2009 | Hwang et al. | 134/21 |
| 2010/0132319 | A1 | 6/2010 | Ashbee et al. | |
| 2010/0263161 | A1 | 10/2010 | Lee et al. | |

FOREIGN PATENT DOCUMENTS

| | | | |
|---|---|---|---|
| CN | 2162679 | Y | 4/1994 |
| CN | 2186039 | Y | 12/1994 |
| CN | 2409894 | Y | 12/2000 |
| CN | 1334061 | A | 2/2002 |
| CN | 1434749 | A | 8/2003 |
| CN | 1593324 | A | 3/2005 |
| CN | 1695537 | A | 11/2005 |
| CN | 1695538 | A | 11/2005 |
| CN | 1777385 | A | 5/2006 |
| CN | 1778246 | A | 5/2006 |
| DE | 102 40 618 | A1 | 9/2003 |
| EP | 0 373 353 | | 6/1990 |
| EP | 0 375 327 | | 6/1990 |
| EP | 0 681 808 | | 11/1995 |
| EP | 1 136 028 | B1 | 9/2001 |
| EP | 1 371 318 | A2 | 12/2003 |
| EP | 1 671 569 | | 6/2006 |
| EP | 1 671 570 | A1 | 6/2006 |
| EP | 1 733 669 | A1 | 12/2006 |
| EP | 1 857 032 | A2 | 11/2007 |
| FR | 2 823 091 | A1 | 10/2002 |
| GB | 2 368 516 | A | 5/2002 |
| GB | 2 377 881 | A | 1/2003 |
| GB | 2 388 769 | B | 4/2004 |
| GB | 2 404 887 | A | 2/2005 |
| GB | 2 406 064 | A | 3/2005 |
| GB | 2 416 721 | A | 2/2006 |
| GB | 2466625 | | 6/2010 |
| JP | 1972-14759 | | 8/1972 |
| JP | 50-22355 | | 3/1975 |
| JP | 53-051663 | | 5/1978 |
| JP | 54-028457 | | 3/1979 |
| JP | 54-51259 | | 4/1979 |
| JP | 54-085560 | A | 7/1979 |
| JP | 54-085561 | A | 7/1979 |
| JP | 54-112357 | | 8/1979 |
| JP | 54-114366 | U | 8/1979 |
| JP | 54-114367 | U | 8/1979 |
| JP | 54-161751 | A | 12/1979 |
| JP | 55-074553 | U | 5/1980 |
| JP | 58-84066 | A | 5/1983 |
| JP | 58-175532 | A | 10/1983 |
| JP | 58-218934 | A | 12/1983 |
| JP | 64-029246 | A | 1/1989 |
| JP | 02-007927 | A | 1/1990 |
| JP | 4-116933 | U | 10/1992 |
| JP | 06-054778 | A | 3/1994 |
| JP | 07-241265 | A | 9/1995 |
| JP | 07-313412 | | 12/1995 |
| JP | 08-000514 | A | 1/1996 |
| JP | 08-112223 | A | 5/1996 |
| JP | 08-140907 | A | 6/1996 |
| JP | 10-243900 | A | 9/1998 |
| JP | 11-004789 | A | 1/1999 |
| JP | 2000-262449 | A | 9/2000 |
| JP | 2002-143060 | A | 5/2002 |
| JP | 2002-187336 | A | 7/2002 |
| JP | 2002-360474 | A | 12/2002 |
| JP | 2003-019097 | A | 1/2003 |
| JP | 2003-119575 | A | 4/2003 |
| JP | 2003-125995 | A | 5/2003 |
| JP | 2003-190056 | A | 7/2003 |
| JP | 2003-199695 | A | 7/2003 |
| JP | 2003-524522 | A | 8/2003 |
| JP | 2003-310502 | A | 11/2003 |
| JP | 2003-310506 | A | 11/2003 |
| JP | 2004-065357 | A | 3/2004 |
| JP | 2004-528087 | A | 9/2004 |
| JP | 2004-528876 | | 9/2004 |
| JP | 2005-034213 | A | 2/2005 |
| JP | 2005-324002 | | 11/2005 |
| JP | 2006-3119575 | U | 2/2006 |
| JP | 2006-061439 | A | 3/2006 |

(56) References Cited

FOREIGN PATENT DOCUMENTS

| | | | |
|---|---|---|---|
| JP | 2006-068500 | A | 3/2006 |
| JP | 2006-340972 | | 12/2006 |
| JP | 2007-007381 | A | 1/2007 |
| JP | 2008-073066 | A | 4/2008 |
| KR | 10-1993-0008369 | B1 | 8/1993 |
| KR | 10-1995-0016643 | | 7/1995 |
| KR | 10-1999-0050243 | | 7/1999 |
| KR | 10-1999-0055544 | | 7/1999 |
| KR | 20-2000-0011635 | | 7/2000 |
| KR | 10-2001-0081856 | | 8/2001 |
| KR | 10-2001-0087691 | | 9/2001 |
| KR | 10-2002-0012383 | | 2/2002 |
| KR | 10-2002-0091510 | A | 12/2002 |
| KR | 10-2003-0094869 | | 12/2003 |
| KR | 10-0437369 | | 6/2004 |
| KR | 10-2005-0005611 | A | 1/2005 |
| KR | 10-2005-0013694 | A | 2/2005 |
| KR | 10-2005-0025711 | | 3/2005 |
| KR | 10-2005-0040122 | | 5/2005 |
| KR | 10-2005-0108623 | | 11/2005 |
| KR | 10-2005-0109145 | | 11/2005 |
| KR | 10-0546629 | B1 | 1/2006 |
| KR | 10-0553042 | B1 | 2/2006 |
| KR | 10-2006-0031442 | A | 4/2006 |
| KR | 10-2006-0116992 | A | 11/2006 |
| KR | 10-0730956 | B1 | 6/2007 |
| KR | 10-2007-084834 | A | 8/2007 |
| KR | 10-2007-0088022 | A | 8/2007 |
| KR | 10-2007-0088023 | | 8/2007 |
| KR | 10-2007-0112324 | | 11/2007 |
| KR | 10-2007-0113353 | | 11/2007 |
| KR | 10-0800188 | B1 | 1/2008 |
| KR | 10-0800189 | B1 | 1/2008 |
| KR | 10-0838886 | B1 | 6/2008 |
| KR | 10-0838887 | B1 | 6/2008 |
| RU | 2 172 132 | C1 | 8/2001 |
| RU | 2 243 714 | C1 | 1/2005 |
| RU | 2 269 919 | C2 | 9/2005 |
| WO | WO 00/74548 | A1 | 12/2000 |
| WO | WO 01/35809 | A1 | 5/2001 |
| WO | WO 01/60524 | A1 | 8/2001 |
| WO | WO 0174493 | | 10/2001 |
| WO | WO 2004/064591 | A2 | 8/2004 |
| WO | WO 2005/099545 | A1 | 10/2005 |
| WO | WO 2008/114966 | | 9/2008 |

OTHER PUBLICATIONS

U.S. Office Action issued in U.S. Appl. No. 12/720,160 dated Jun. 24, 2013.
U.S. Office Action issued in U.S. Appl. No. 12/406,803 dated Aug. 21, 2013.
Russian Office Action dated Oct. 19, 2010 issued in Application No. 2009143355 (with English translation).
Chinese Office Action dated Oct. 27, 2010 issued in Application No. 200610168848.0 (with English translation).
Chinese Office Action dated Nov. 9, 2010 issued in Application No. 200610169333.2 (with English translation).
U.S. Notice of Allowance dated Jan. 12, 2011 issued in U.S. Appl. No. 11/965,133.
U.S. Office Action issued in U.S. Appl. No. 12/406,779 dated Feb. 3, 2011.
U.S. Office Action issued in U.S. Appl. No. 11/831,473 dated Feb. 4, 2011.
U.S. Office Action issued in U.S. Appl. No. 12/408,066 dated Feb. 10, 2011.
U.S. Office Action issued in U.S. Appl. No. 12/710,585 dated Feb. 10, 2011.
U.S. Office Action issued in U.S. Appl. No. 12/404,739 dated Feb. 18, 2011.
U.S. Office Action issued in U.S. Appl. No. 12/404,692 dated Mar. 9, 2011.
U.S. Office Action issued in U.S. Appl. No. 12/404,715 dated Mar. 9, 2011.
U.S. Notice of Allowance issued in U.S. Appl. No. 12/408,066 dated Mar. 21, 2011.
U.S. Notice of Allowance issued in U.S. Appl. No. 12/407,224 dated Mar. 28, 2011.
European Search Report dated Jan. 27, 2011. (Application No. 06125798.6-2316/1852048).
Russian Office Action dated Feb. 2, 2011 (Application No. 2009143355) (with translation).
U.S. Office Action dated Jul. 23, 2010 issued in U.S. Appl. No. 12/408,066.
U.S. Office Action issued in U.S. Appl. No. 12/407,243 dated Sep. 19, 2012.
U.S. Office Action issued in U.S. Appl. No. 12/720,160 dated Dec. 4, 2012.
U.S. Office Action issued in U.S. Appl. No. 12/704,915 dated Dec. 10, 2012.
U.S. Office Action issued in U.S. Appl. No. 12/407,243 dated Nov. 16, 2011.
U.S. Office Action issued in U.S. Appl. No. 12/404,692 dated Dec. 7, 2011.
U.S. Office Action issued in U.S. Appl. No. 12/404,715 dated Dec. 8, 2011.
U.S. Notice of Allowance issued in U.S. Appl. No. 12/710,585 dated Dec. 30, 2011.
U.S. Office Action issued in U.S. Appl. No. 12/407,975 dated Jan. 30, 2012.
U.S. Office Action issued in U.S. Appl. No. 12/704,901 dated Jan. 29, 2014.
U.S. Notice of Allowance issued in U.S. Appl. No. 12/407,293 dated Jun. 29, 2011.
U.S. Office Action issued in U.S. Appl. No. 12/407,243 dated Jul. 18, 2011.
U.S. Office Action issued in U.S. Appl. No. 12/404,692 dated Jul. 20, 2011.
U.S. Office Action issued in U.S. Appl. No. 12/404,715 dated Jul. 22, 2011.
U.S. Office Action issued in U.S. Appl. No. 12/407,975 dated Jul. 28, 2011.
U.S. Office Action issued in U.S. Appl. No. 12/704,901 dated Mar. 25, 2013.
U.S. Notice of Allowance issued in U.S. Appl. No. 12/407,243 dated Jun. 6, 2013.
European Search Report dated Mar. 19, 2012.
U.S. Office Action issued in U.S. Appl. No. 12/407,243 dated Apr. 6, 2012.
U.S. Notice of Allowance issued in U.S. Appl. No. 12/404,715 dated Apr. 26, 2012.
U.S. Office Action dated Nov. 3, 2010 issued in U.S. Appl. No. 12/710,585.
U.S. Final Office Action dated Nov. 8, 2010 issued in U.S. Appl. No. 12/406,803.
U.S. Office Action dated Nov. 12, 2010 issued in U.S. Appl. No. 12/704,933.
Russian Office Action dated Sep. 28, 2007 issued in Application No. 2007103559 (translation only).
Russian Office Action dated Oct. 1, 2007 issued in Application No. 2007103555 (translation).
U.S. Office Action dated Feb. 11, 2008 issued in U.S. Appl. No. 11/831,473.
U.S. Office Action dated Feb. 11, 2008 issued in U.S. Appl. No. 11/831,564.
Australian Office Action dated Apr. 15, 2008 issued in Application No. 2007200407.
Australian Office Action dated Apr. 17, 2008 issued in Application No. 2007200408.
Russian Office Action dated Apr. 21, 2008 issued in Application No. 2007103560 (with translation).
Australian Office Action dated Apr. 24, 2008 issued in Application No. 2007200409.
European Office Action dated May 8, 2008 issued in Application No. 07 101 388.2-2316.

(56) References Cited

OTHER PUBLICATIONS

Australian Office Action dated Jun. 3, 2008 issued in Application No. 2006249267.
U.S. Final Office Action dated Jul. 24, 2008 issued in U.S. Appl. No. 11/831,473.
U.S. Office Action dated Jul. 28, 2008 issued in U.S. Appl. No. 11/712,958.
U.S. Office Action dated Aug. 28, 2008 issued in U.S. Appl. No. 11/713,022.
U.S. Office Action dated Sep. 19, 2008 issued in U.S. Appl. No. 11/831,564.
U.S. Office Action dated Oct. 20, 2008 issued in U.S. Appl. No. 11/831,473.
International Search Report and Written Opinion dated Dec. 10, 2008 issued in Application No. PCT/KR2008/004849.
Chinese Office Action dated Dec. 12, 2008 issued in Application No. 200710002992.1 (translation).
U.S. Final Office Action dated Mar. 9, 2009 issued in U.S. Appl. No. 11/713,022.
Russian Office Action dated Mar. 25, 2009 issued in Application No. 2008102660 (with translation).
Chinese Office Action dated Apr. 3, 2009 issued in Application No. 200710002990.2 (with translation).
Australian Office Action dated Apr. 16, 2009 issued in Application No. 2008200340.
Chinese Office Action dated May 8, 2009 issued in Application no. 200610153199.7 (translation).
U.S. Office Action dated May 13, 2009 issued in U.S. Appl. No. 11/965,133.
Chinese Office Action dated May 22, 2009 issued in Application No. 200710002292.1 (translation).
U.S. Final Office Action dated May 28, 2009 issued in U.S. Appl. No. 11/831,473.
Chinese Office Action dated Jun. 5, 2009 issued in Application No. 200610169333.2 (translation).
European Search Report dated Jun. 16, 2009 issued in Application No. 06 12 5823 (in English).
Chinese Office Action dated Jul. 3, 2009 issued in Application No. 200610168848.0 (with translation).
Chinese Office Action dated Aug. 21, 2009 issued in Application No. 200710002991.7 (with translation).
Chinese Office Action dated Aug. 21, 2009 issued in Application No. 200810008716.0 (with translation).
U.S. Office Action dated Sep. 3, 2009 issued in U.S. Appl. No. 11/831,564.
U.S. Office Action dated Sep. 10, 2009 issued in U.S. Appl. No. 11/565,241.
U.S. Office Action dated Oct. 6, 2009 issued in U.S. Appl. No. 12/406,803.
European Search Report dated Oct. 15, 2009 issued in Application No. 06 12 5560.0-2316.
Chinese Office Action dated Nov. 13, 2009 issued in Application No. 200710085701.X (with translation).
Canadian Office Action dated Nov. 18, 2009 issued in Application No. 2,598,113.
Canadian Office Action dated Nov. 18, 2009 issued in Application No. 2,598,117.
Chinese Office Action dated Dec. 11, 2009 issued in Application No. 200710002992.1 (with translation).
U.S. Notice of Allowance dated Jan. 13, 2010 issued in U.S. Appl. No. 11/965,133.
European Search Report dated Jan. 20, 2010 issued in Application No. 06 12 5560.
Chinese Office Action dated Feb. 5, 2010 issued in Application No. 200710002991.7 (with translation).
U.S. Notice of Allowance dated Feb. 19, 2010 issued in U.S. Appl. No. 11/565,241.
U.S. Notice of Allowance dated Feb. 24, 2010 issued in U.S. Appl. No. 11/831,564.
U.S. Office Action dated Apr. 19, 2010 issued in U.S. Appl. No. 11/565,206.
U.S. Notice of Allowance dated Apr. 21, 2010 issued in U.S. Appl. No. 11/831,519.
U.S. Office Action dated May 14, 2010 issued in U.S. Appl. No. 11/831,473.
U.S. Office Action dated May 26, 2010 issued in U.S. Appl. No. 12/406,803.
Canadian Office Action dated Jun. 30, 2010 issued in Application No. 2,598,113.
U.S. Office Action dated Jul. 9, 2010 issued in U.S. Appl. No. 11/965,133.
Office Action dated Jul. 23, 2010 issued in U.S. Appl. No. 12/408,066.
U.S. Office Action dated Aug. 18, 2010 issued in U.S. Appl. No. 12/406,779.
U.S. Office Action dated Sep. 1, 2010 issued in U.S. Appl. No. 11/831,473.
U.S. Notice of Allowance dated Oct. 1, 2010 issued in U.S. Appl. No. 11/565,206.
U.S. Office Action issued in U.S. Appl. No. 12/704,901 dated Oct. 3, 2013.

* cited by examiner

VACUUM CLEANER

This application claims priority to U.S. Provisional Application No. 61/160,035, filed Mar. 13, 2009, which is hereby incorporated by reference.

BACKGROUND

1. Field

A vacuum cleaner is disclosed herein.

2. Background

Vacuum cleaners are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to embodiments, examples of which are illustrated in the accompanying drawings. In the following detailed description of embodiments, reference is made to the accompanying drawings that form a part hereof, and in which is shown by way of illustration embodiments in which the invention may be practiced. These embodiments are described in sufficient detail to enable those skilled in the art to practice the invention, and it should be understood that other embodiments may be utilized and that logical structural, mechanical, electrical, and chemical changes may be made without departing from the spirit or scope of the invention. To avoid detail not necessary to enable those skilled in the art to practice the invention the description may omit certain information known to those skilled in the art. The following detailed description is, therefore, not to be taken in a limiting sense, and the scope is defined only by the appended claims.

In general, a vacuum cleaner is an apparatus that filters dust in a dust separation device after sucking the air including the dust using suction power generated by a suction motor mounted in a main body. The vacuum cleaner may include a main body with the suction motor disposed therein, the dust separation device that separates dust from the sucked air, and a dust tank that stores dust separated by the dust separation device.

Figure 1:
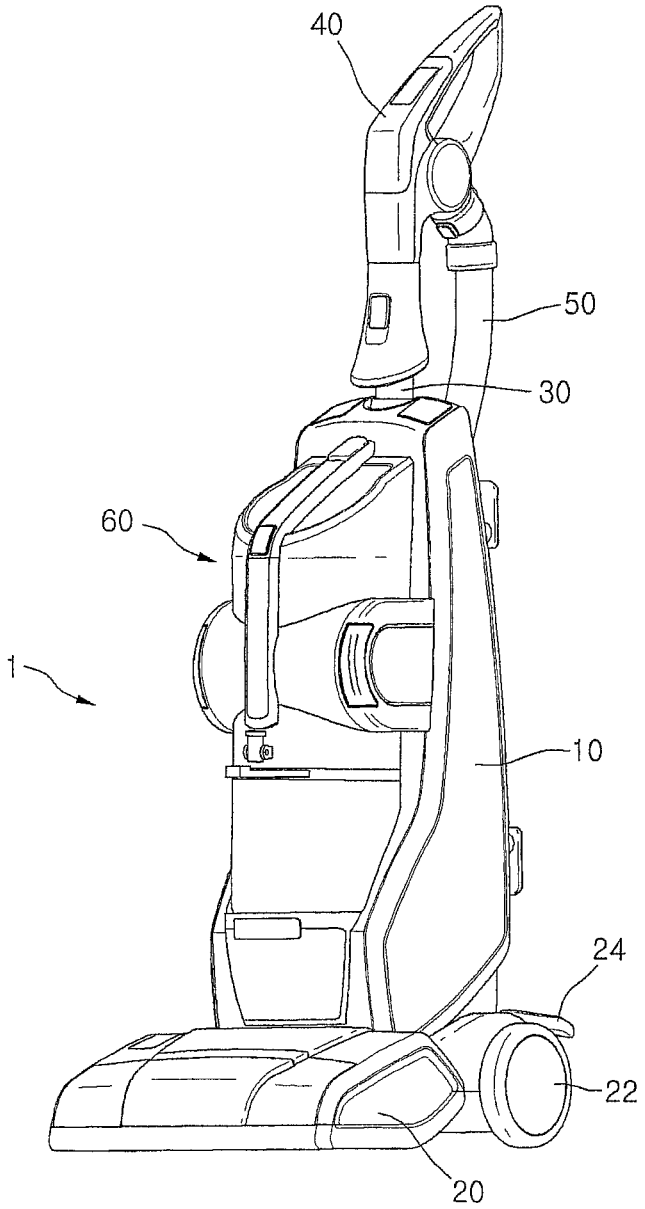
FIG. 1 is a perspective view of a vacuum cleaner according to an embodiment.
Figure 2:
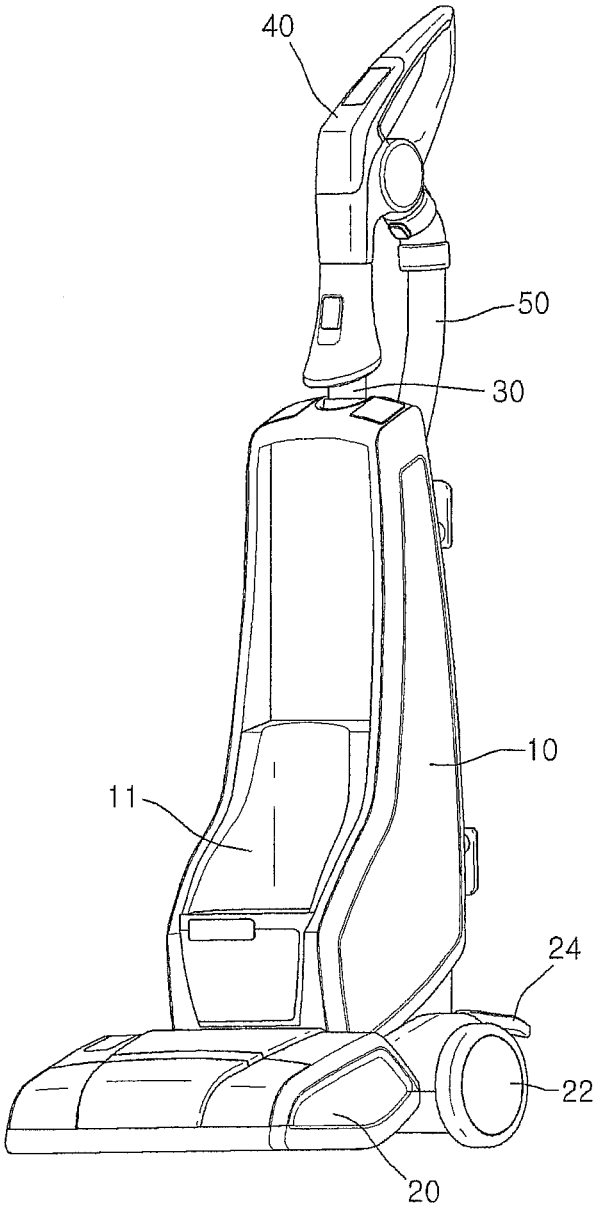
FIG. 2 is a perspective view of the vacuum cleaner of FIG. 1 showing a dust separator separated therefrom.

FIG. 1 is a perspective view of a vacuum cleaner according to an embodiment, and FIG. 2 is a perspective view of a vacuum cleaner of FIG. 1 showing a dust separator separated therefrom. In FIG. 1, as one example of a vacuum cleaner, an upright-type vacuum cleaner is shown; however, the embodiment may be applied to other type vacuums as well, such as a canister-type vacuum cleaner or a robot cleaner.

Referring to FIGS. 1 and 2, the vacuum cleaner 1 according to this embodiment may include a main body 10 with a suction motor (not shown) that generates a sucking power, a suction nozzle 20, which may be rotatably connected at a lower part of the main body 10 and may contact a surface or floor, a dust separator 60, which may be removably mounted on the main body 10, a suction tube 30, which may be removably mounted on the main body 10, a handle 40 connected to the suction tube 30, and a connection hose 50, which may connect the main body 10 with the handle 40. A wheel 22 that facilitates movement of the suction nozzle 20 may be provided at each side of the suction nozzle 20. An operation lever 24 may be provided to rotate the suction nozzle 20 with respect to the main body 10 which stands upright. The operation lever 24 may be provided at a backside of the suction nozzle 20.

The dust separator 60 may be removably mounted on a mounting portion 11, which may be formed in a front part of the main body 10, and the suction tube 30 may be removably mounted a rear part of the main body 10. The dust separator 60 may separate dust from air sucked into the main body 10 and store the separated dust.

Hereinafter, a structure of the dust separator 60 will be described in more detail herein below.

Figure 3:
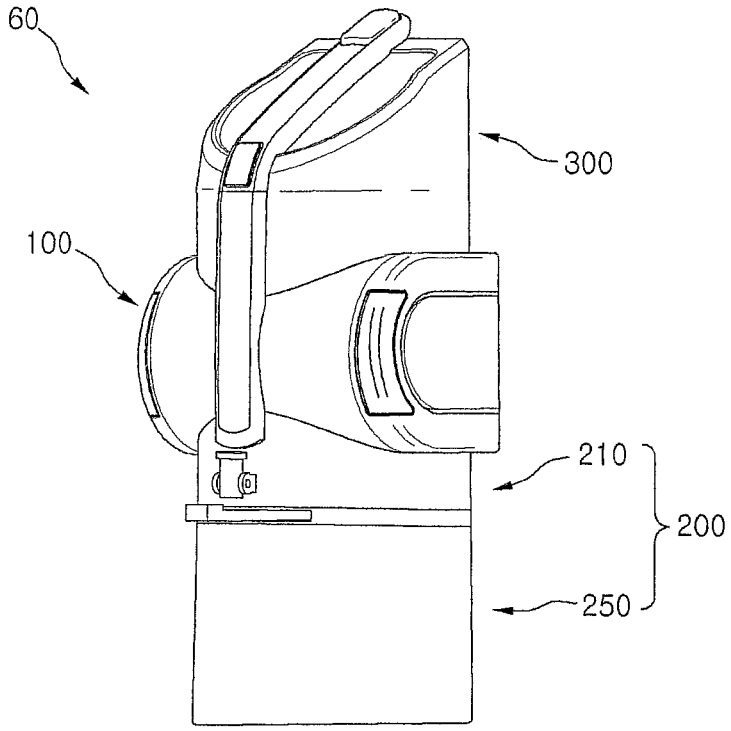
FIG. 3 is a perspective view of the dust separator according to the embodiment of FIG. 1.
Figure 4:
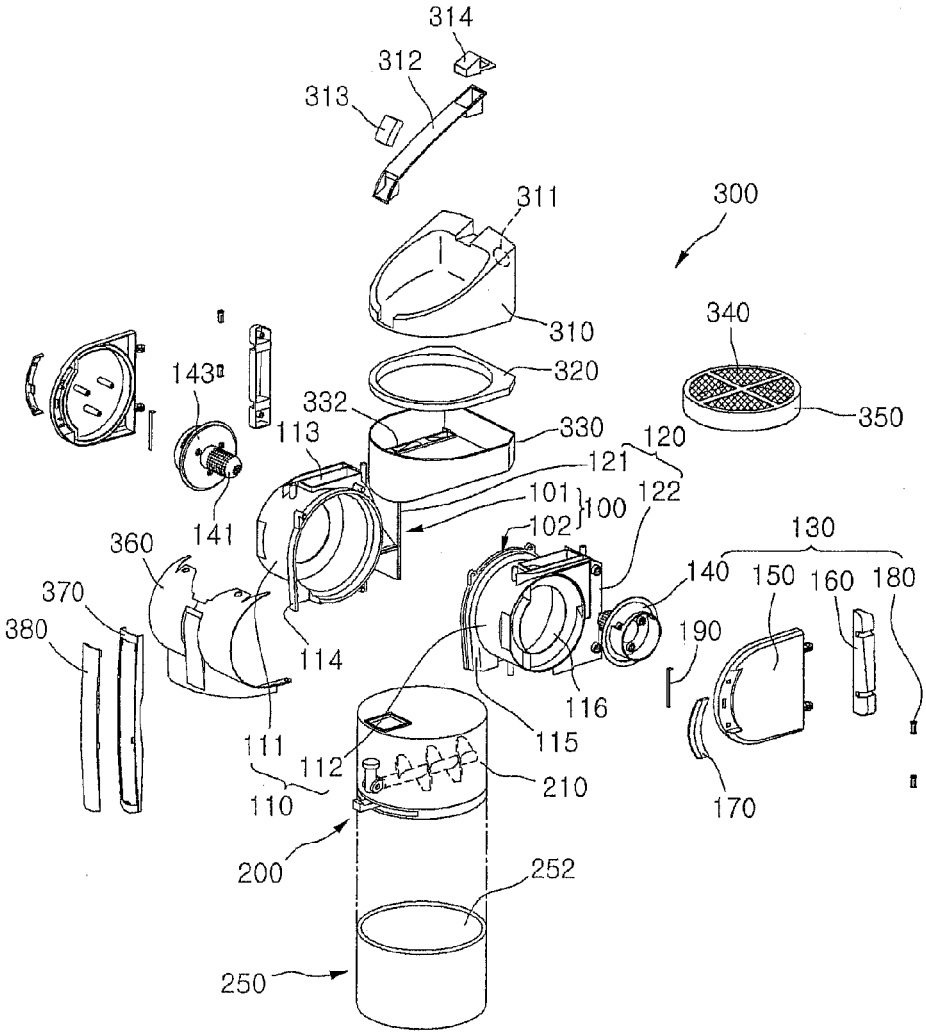
FIG. 4 is an exploded perspective view of the dust separator according to the embodiment of FIG. 1.

FIG. 3 is a perspective view of the dust separator according to the embodiment of FIG. 1. FIG. 4 is an exploded perspective view of the dust separator according to embodiment of FIG. 1.

Referring to FIGS. 3 and 4, the dust separator 60 according to this embodiment may include a dust separation device 100 that separates dust from sucked air, a discharge guide device 300 that guides a flow of air discharged from the dust separation device 100, and a dust storage device 200 into which dust separated from the dust separation device 100 may be introduced. The dust storage device 200 may include a compression device 210 that compresses dust separated from the dust separation device 100 and a dust tank 250 into which the dust compressed in the compression device 210 may be introduced and the introduced dust stored.

The dust separation device 100 may be connected to an upper part of the compression device 210 and a lower part of the discharge guide device 300. The dust tank 250 may be separately connected to the lower part of the compression device 210. The dust tank 250 may be connected to the compression device 210 by, for example, a hook mechanism; however, embodiments are not limited thereto.

In addition, a deco cover 360 may be coupled to the dust separation device 100. When the compression device 210 and the dust separation device 100 are coupled to each other, an inner deco 370 and an outer deco 380 may be coupled to the deco cover 360 and the compression device 210. The deco cover 360, the inner deco 370, and the outer deco 380 may improve aesthetics of the dust separator 60.

The dust separation device 100 may include a cyclone device 110 that separates dust in air, a distribution device 120 that guides air, light, and dust to the cyclone device 110, and a plurality of filter devices 130 rotatably coupled to the cyclone device 110 that filters air through dust separation. More specifically, the dust separation device 100 may include a first dust separation body 101 and a second dust separation body 102, which may be coupled to each other. The first dust separation body 101 may include a first cyclone body 111 that generates a first cyclone flow and a first distribution body 121, which may be formed integrally with the first cyclone body 111 and guide air to the first cyclone body 111. The second dust separation body 102 may include a second cyclone body 112 that generates a second cyclone flow and a second distribution body 122, which may be formed integrally with the second cyclone body 112 and guide air to the second cyclone body 112. In addition, the first cyclone body 111 and the second cyclone body 112 may form the cyclone device 110 and the first distribution body 121 and the second distribution body 122 may form the distribution device 120.

Each of the first and second cyclone bodies 111 and 112 may include an air suction portion 113. Therefore, a plurality of air suction portions 113 may be formed in the cyclone device 110. Further, a first dust discharge portion 114 may be integrally formed in the first cyclone body 111 and a second dust discharge portion 115 may be integrally formed in the second cyclone body 112. When the first cyclone body 111 and the second cyclone body 112 are coupled to each other, the first dust discharge portion 114 and the second dust discharge portion 115 may be coupled to each other to form a single dust discharge portion.

Each of the filter devices 130 may include a filter member 140 inserted into an inside of the cyclone device 110 from outside of the cyclone device 110, a cover member 150 coupled with the filter member 140, a cover coupler 160 coupled with the cover member 150 to rotatably support the cover member 150, a coupling member 170 operated to rotate the cover member 150 by being coupled with the cover member 150, an elastic member 190 that elastically supports the coupling member 170, and a shaft 180 adapted to rotatably connect the cover member 150 to the cover coupler 160.

The cover coupler 160 may be coupled to the distribution device 120. Moreover, the cover coupler 160 may be integrally coupled to the distribution device 120. The filter member 140 may include a filter body 141 and an opening cover 143 that extends from an outer peripheral surface of the filter body 141. The filter body 141 may selectively penetrate an exhaust opening 116 formed in the cyclone device 110 and the opening cover 143 may selectively open/close the exhaust opening 116.

The discharge guide device 300 may include an exhaust member 330 coupled to an upper part of the dust separation device 100, an exhaust filter 340 seated on the exhaust member 330 to filter exhausted air, a filter housing 350 that protects the exhaust filter 340, a filter seating guide 320 coupled to the exhaust member 330 that guides seating of the filter housing 350 coupled with the exhaust filter 340, and an upper cover 310 rotatably coupled to an upper part of the exhaust member 330. An air discharge hole 311 that discharges air may be formed in the upper cover 310. The air passing through the air discharge hole 311 may move to the main body 10.

A handle portion 312 that facilitates a user gripping the dust separator 60 may be coupled to the upper cover 310. The handle portion 312 may include a first coupling button 313 that fixes a position of the upper cover 310 and a second coupling button 314 that couples the dust separator 60 to the main body 10. The first coupling button 313 may be selectively coupled with the inner deco 370. In addition, an exhaust passage 332, through which the air discharged from the dust separation device 100 may flow, may be formed in the exhaust member 330. The air discharged to the exhaust passage 332 may pass through the exhaust filter 340, and then, may be discharged through the air discharge hole 311.

The dust separated by the dust separation device 100 may be introduced into the compression device 200. The introduced dust may be compressed in the inside of the compression device 200 and selectively discharged to the dust tank 250.

A dust storage portion 252 that stores the compressed dust may be formed in the dust tank 250. That is, in this embodiment, only the dust storage portion 252 that stores the compressed dust may be formed in the dust tank 250, such that the structure of the dust tank 250 may be simplified. Further, since a user may discharge dust by separating only the dust tank 250 from the compression device 210, the structure of the dust tank 250 may be light-weight and the dust tank 250 easy to handle.

Hereinafter, the structure of the compression device will be described in more detail.

Figure 5:
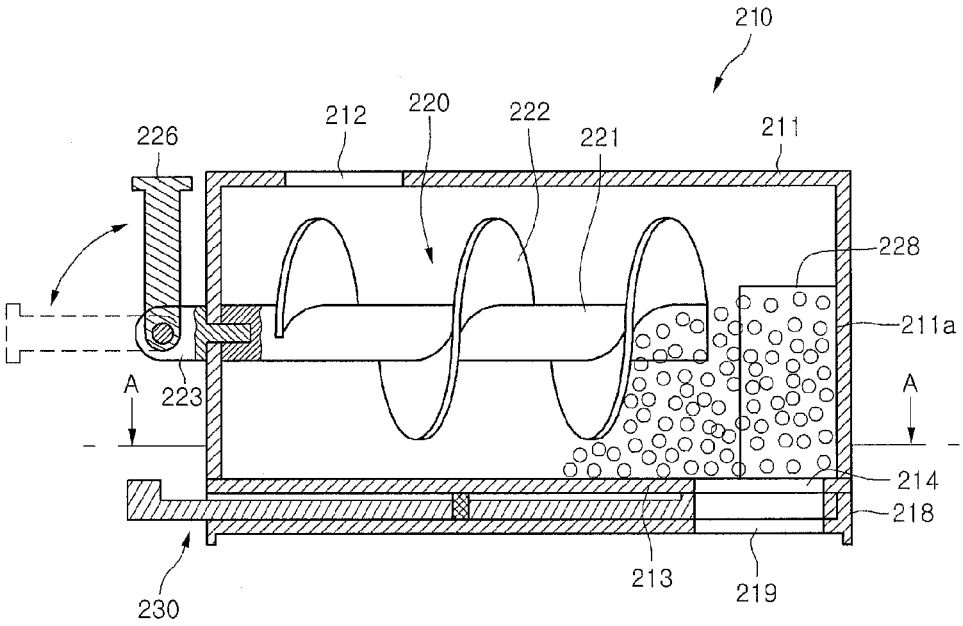
FIG. 5 is a vertical cross-sectional view of a compression device according to the embodiment of FIG. 1.
Figure 6:
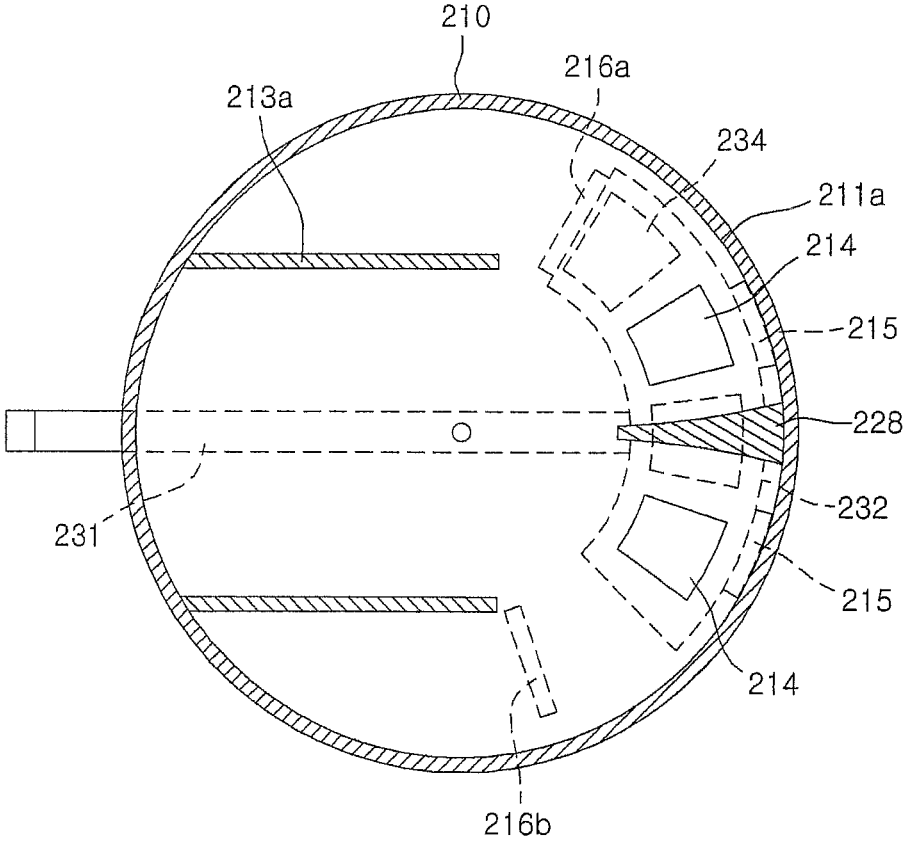
FIG. 6 is a cross-sectional view taken along line VI-VI of FIG. 5.
Figure 7:
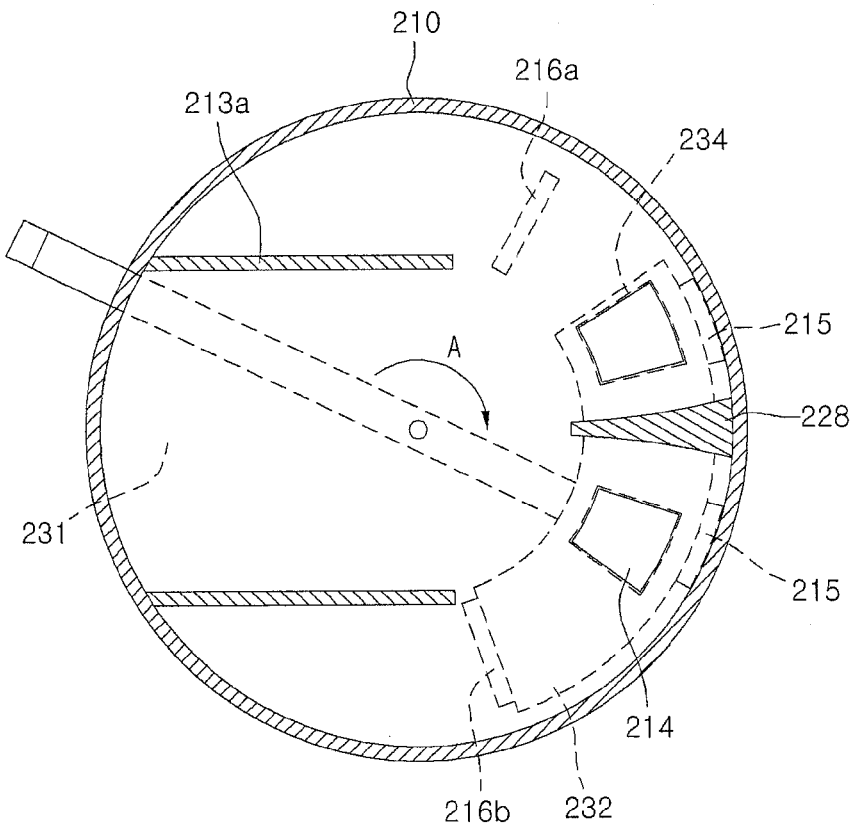
FIG. 7 is a cross-sectional view taken along line VI-VI of FIG. 5, in a state in which communication of the compression device and a dust tank is opened and closed by an opening and closing device.

FIG. 5 is a vertical cross-sectional view of a compression device according to the embodiment of FIG. 1. FIG. 6 is a cross-sectional view taken along VI-VI of FIG. 5. FIG. 7 is a cross-sectional view taken along line VI-VI of FIG. 5, in a state in which communication of a compression device and a dust tank is opened and closed by an opening and closing device.

Referring to FIGS. 3 to 7, the compression device 210 according to this embodiment may include a compression body 211 that forms a compression space, a compression member 220 that compresses the dust introduced into the compression body 211, a drive device 226 that drives the compression member 220 and an opening/closing device 230 that selectively communicates the compression body 211 and the dust tank 250 with each other. More specifically, a dust introduction portion 212, into which the dust discharged from the dust discharge portions 114 and 115 may be introduced, may be formed on an upper part of the compression body 211. A lower part of the compression body 211 may be open. A lower opening of the compression body 211 may be covered by a lower wall 213. The lower wall 213 may form a bottom surface of the compression body 211. In addition, one or more discharge holes 214 that discharges the compressed dust may be formed in the lower wall 213.

The compression member 220 may be rotatably provided within the compression body 211. The compression member 220 may include a rotating shaft 221 and a blade 222, which may be formed at an outer peripheral surface of the rotating shaft 221 and which may be formed in a spiral shape.

The rotating shaft 221 may be disposed inside of the compression body 211 and may extend in a horizontal direction. The blade 222 may be designed to move dust inside the compression body 211 from one side to the other side when the rotating shaft 221 rotates in one direction.

Therefore, as the compression member 220 is rotatably operated, dust may be moved from one side to the other side of the compression body 211 by the rotation of the compression member 220, that is, in a horizontal direction. The dust may be collected against a compression surface 211*a* of the compression body 211 by the rotation of the compression member 220, such that the dust is compressed. The dust introduction portion 212 may be disposed at a position adjacent to an opposite surface to the compression surface 211*a*, so that the dust flowing into the compression body 211 may be moved by the compression member 220 to or toward the compression surface 211*a*.

A drive device 226 may be provided outside of the compression body 211 and may be connected to the compression member 220 by a transfer device 223. A portion of the transfer device 223 may be inserted into the rotating shaft 221 of the compression member 220 by penetrating through the compression body 211. The drive device 226 may be rotatably connected to the transfer device 223. Therefore, when not in use, the drive device 226 may be rotated to an upper part or position. On the other hand, when the drive device 226 is in use, the drive device 226 may be rotated to a lower part or position, such that the drive device 226 and the rotating shaft 221 extend in a straight line.

The opening/closing device 230 may include an operation portion 231 for a user's operation and an opening/closing member 232 that opens/closes the discharge hole 214 by operation of the operation portion 231. In more detail, the lower wall 213 may be provided with a pair of guide ribs 213*a* that guides dust moved by the compression member 220. The pair of guide ribs 213*a* may be arranged in parallel and the compression member 220 may be positioned between the pair of guide ribs 213*a*.

The lower wall 213 may be further provided with a plurality of the discharge holes 214. FIGS. 6 and 7 show, by way of example, a case in which two discharge holes 214 are provided. The lower wall 213 may be provided with a discharge guide 228 that divides dust toward two discharge holes 214 and guides the dust thereto. That is, the discharge guide 228 may be positioned between two discharge holes 214. Therefore, dust compressed at both sides of the discharge guide 228 may be discharged to the outside through the two discharge holes 214. The discharge guide 228 may be positioned adjacent to the compression surface 211*a*. Further, the discharge guide 228 may be integrally formed with the compression surface 211*a*.

The opening/closing member 232 may be rotatably provided below the lower wall 213. The opening/closing member 232 may be provided with two communication holes 234 that selectively communicate with the two discharge holes 214. The two communication holes 234 may define a discharge channel for dust. A gap between the two communication holes 234 may be the same size as a gap between the two discharge holes 214.

In addition, the opening/closing unit 230 may be covered by a lower cover 218. Two opening portions 219 may be formed at positions corresponding to the two discharge holes 214 in the lower cover 240.

Therefore, as shown in FIG. 6, in a state in which the communication holes 234 of the opening/closing member 232 are not aligned with the discharge holes 214 of the lower wall 213, the opening/closing member 232 may close the discharge holes 214. In this state, the compressed dust may be accumulated on an upper surface of the lower wall 213 and an upper surface of the opening/closing member 232 at both sides of the discharge guide 228.

On the other hand, as shown in FIG. 7, when the opening/closing member 232 is rotated in a clockwise direction (arrow A in FIG. 7) by using the operation portion 231, the discharge holes 214, the communication holes 234 and the opening portions 219 may be aligned. Then, the dust accumulated on both sides of the discharge guide 228 may pass through the discharge holes 214, the communication holes 234, and the opening portions 219 in sequence to be discharged outside of the compression device 200.

A guide rib 215 that guides movement of the opening/closing member 232 may be formed in or on the lower cover 218. Further, the lower cover 218 may include a first stopper 216*a* that provides a stop position when the opening/closing member 232 rotates in a direction to close the discharge hole(s) 214, and a second stopper 216*b* that provides a stop position when the opening/closing member 232 rotates in a direction to open the discharge hole(s) 214.

According to this embodiment, the dust separated by the dust separation device 100 may be stored in the compression device 210. The dust stored in the compression device 210 may be compressed by the compression member 220. Thus, the dust may be stored in a compressed state in the compression device 210.

The dust stored in the compression device 210 may be compressed when the dust separator 60 is mounted on or separated from the main body 10. In addition, in a state in which the dust separator 60 is separated from the main body 10, the compressed dust stored in the compression device 210 may be dropped into the dust tank 250 by operating the opening/closing device 230.

As the compressed dust may be dropped and stored in the dust tank 250, a size of the dust tank 250 may be reduced. Further, as the compressed dust may be discharged outside of the dust tank 250, scattering of the dust may be reduced when the compressed dust stored in the dust tank 250 is discharged. As the compressed dust may be stored in the compression device 210, the compression device 210 may be referred to as a first storage device and the dust tank 250 may be referred to as a second storage device.

Figure 8:
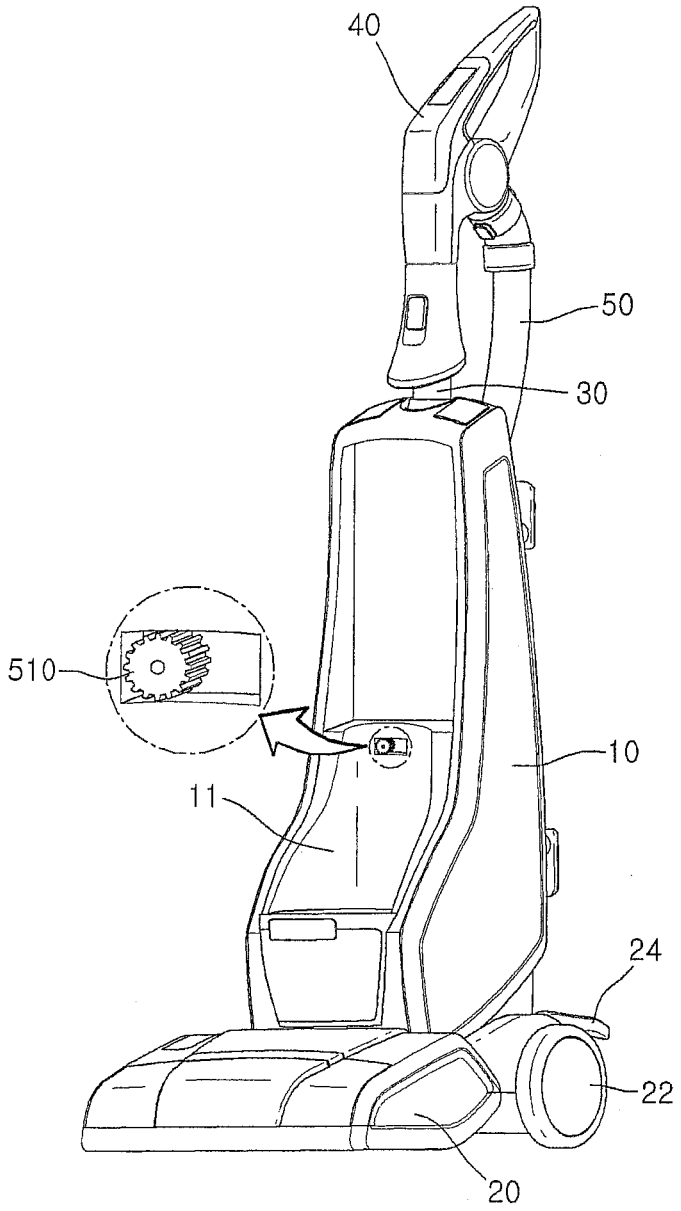
FIG. 8 is a perspective view of a vacuum cleaner, from which a dust separator is separated according to another embodiment.
Figure 9:
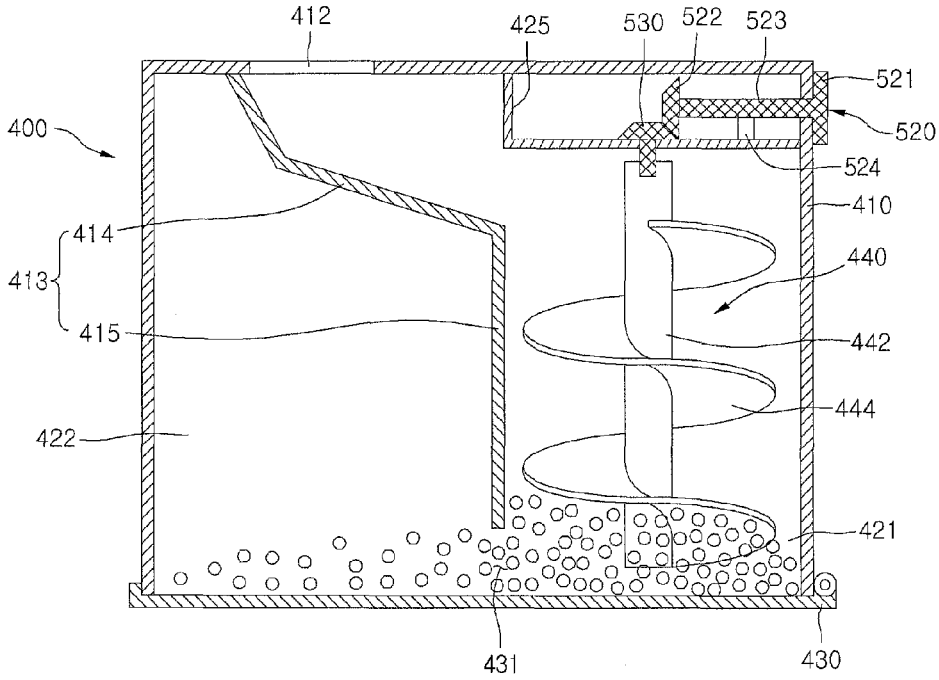
FIG. 9 is a cross-sectional view of a dust storage device of FIG. 8.

FIG. 8 is a perspective view of a vacuum cleaner from which a dust separator is separated according to another embodiment. FIG. 9 is a cross-sectional view of a dust storage device according to the embodiment of FIG. 8. This embodiment is similar to the previous embodiment except for a driving scheme of the structure of the dust storage device and the compression member. Therefore, repetitive disclosure has been omitted.

Referring to FIGS. 8 and 9, a dust storage device 400 according to this embodiment may include a dust tank 410 that stores dust separated by a dust separation device, a lower cover 430 that opens/closes a lower part of the dust tank 410, and a compression member 440 that compresses dust flowing to the dust tank 410.

In more detail, an upper surface of the dust tank 410 may be provided with a dust introduction portion 412 into which dust may flow. The dust introduction portion 412 may be disposed at a position spaced apart from a vertical central line of the dust tank 410.

The compression member 440 may be rotatably provided inside of the dust tank 410. The compression member 440 may include a rotating shaft 442 and a blade 444. The blade 444 may be formed at an outer peripheral surface of the rotating shaft 442 and may be formed in a spiral shape.

The rotating shaft 442 may extend in a substantially up and down or vertical direction inside of the dust tank 410. The blade 444 may be designed to move dust flowing to the dust tank 410 from an upper part to a lower part when the rotating shaft 442 rotates in one direction.

An inside of the dust tank 410 may be provided with a dust guide 413 that guides dust flowing through the dust introduction portion 412 to the compression member 440 side toward a lower portion of the dust storage device 400. In more detail, the dust guide 413 may include an inclined portion 414 that extends at an incline from the dust introduction portion 412 toward a lower portion and a vertical portion 415 that extends substantially vertically from the inclined portion 414 to the lower portion, as shown in FIG. 9. An inner space of the dust tank 410 may be partitioned into a compression space 421, in which dust may be compressed, and a storage space 422, in which the compressed dust may be stored. A lower end portion of the vertical portion 415 may be positioned or spaced a predetermined distance from the lower cover 430 forming a space 431. The dust compressed in the compression space 421 may be moved to the storage space 422 through the space 431 between the vertical portion 415 and the lower cover 430.

The compression member 440 may be automatically rotated by a drive device. The drive device may include a compression motor (not shown) provided in the main body 10 and a power transmission portion that transmits power of the compression motor to the compression member 440.

The power transmission portion may include a first transmission portion 510 connected to the compression motor, a second transmission portion 520, which may be selectively connected with the first transmission portion 510, and a third transmission portion 530, which may be connected with the second transmission portion 520 and coupled to the rotation shaft 442 of the compression member 440. A bidirectionally rotatable motor may be used as the compression motor, as an example. For example, a synchronous motor may be used as the compression motor.

The first transmission portion 510 may be exposed outside of the mounting portion 11, while connected to the compression motor. For example, the first transmission portion 510 may be a gear. For example, a bevel gear may be utilized as the second transmission portion 520 and the third transmission portion 530.

The second transmission portion 520 may include an external gear 521, which may be selectively connected with the first transmission portion 510 and positioned outside of the dust tank 410, and an internal gear 522, which may be connected with the third transmission portion 530. In addition, the external gear 521 and the internal gear 522 may be connected by a connection shaft 523. In addition, the connection shaft 523 may be supported by a supporter 524. When the dust separator device 60 is mounted on the main body 10, the second transmission portion 520 may be connected with the first transmission portion 510, such that the compression member 440 may be rotatable by the compression motor.

The inside of the dust tank 410 may be provided with a cover portion 425 that covers at least a portion of the power transmission portion. For example, the cover portion 425 may form a space configured to receive the third transmission portion 530. The third transmission portion 530 may be inserted into or onto the rotating shaft 442 of the compression member by penetrating through the cover portion 425.

According to this embodiment, as the first compression member 440 may be automatically rotated, problems associated with rotation of the compression member 440 may be reduced or eliminated. In addition, the lower part of the dust tank 410 may be provided with the lower cover 430 that opens/closes the dust tank 410, such that dust may be easily removed when the lower cover 430 is rotated open.

Figure 10:
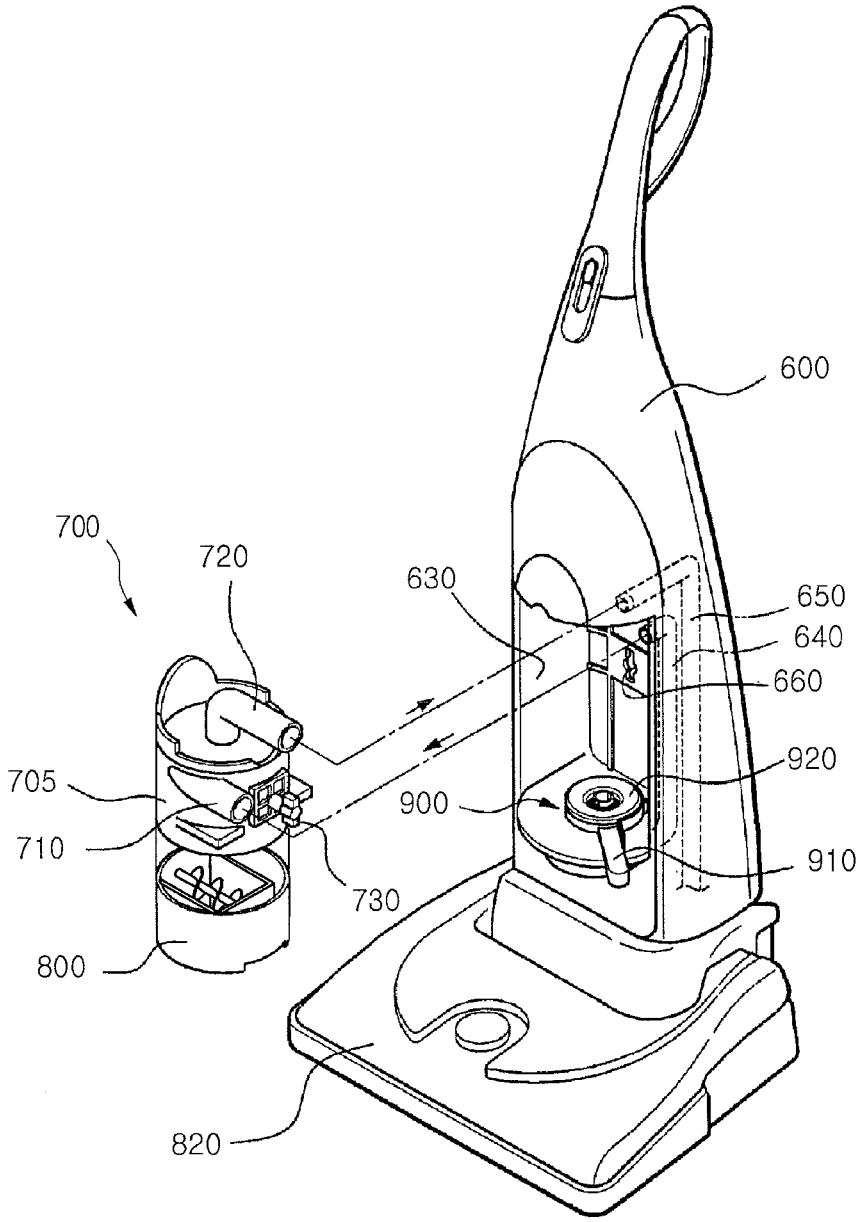
FIG. 10 is an exploded perspective view of a vacuum cleaner according to another embodiment.
Figure 11:
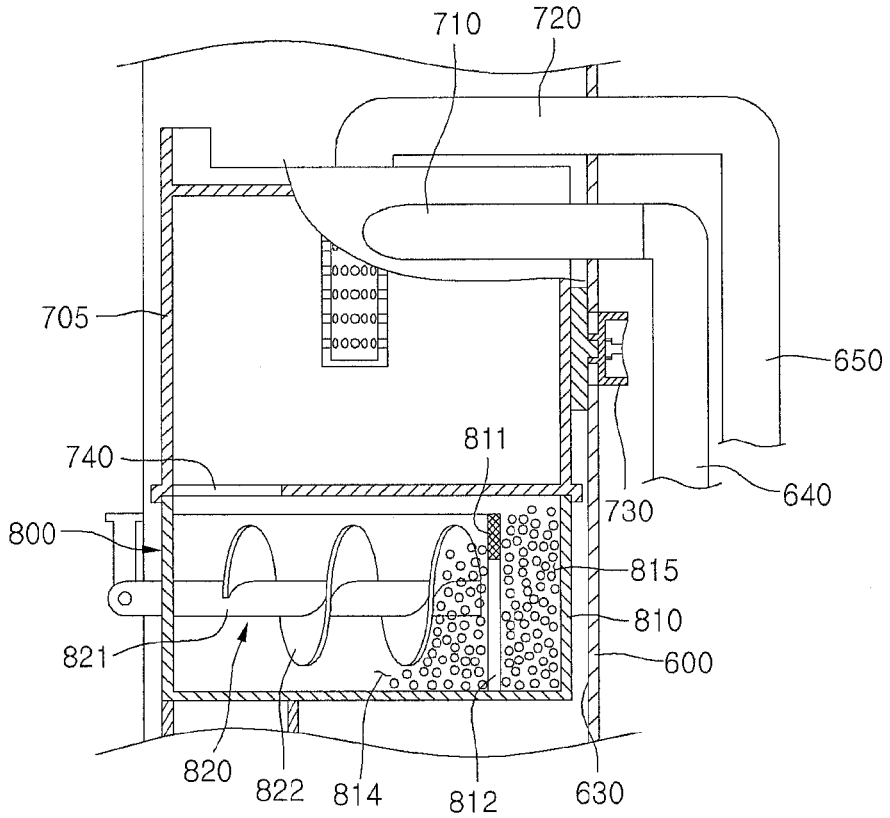
FIG. 11 is a partial cross-sectional view of the vacuum cleaner of FIG. 10 showing a state in which a dust separator is mounted thereon.
Figure 12:
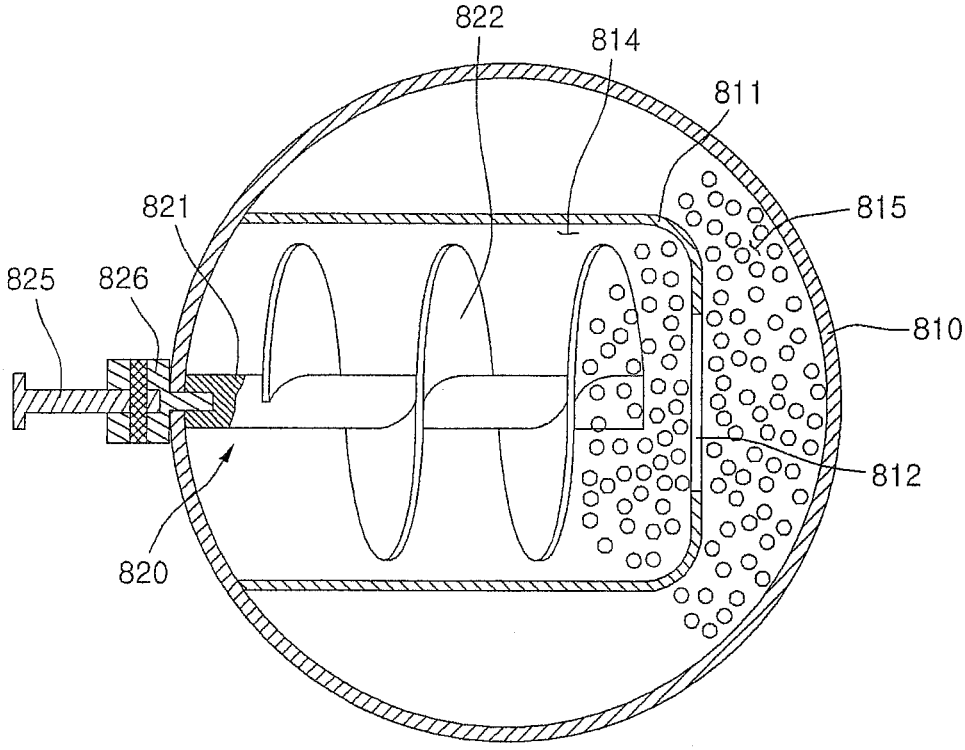
FIG. 12 is a horizontal cross-sectional view of a dust storage device according to the embodiment of FIG. 10.

FIG. 10 is a partial exploded perspective view of a vacuum cleaner according to another embodiment. FIG. 11 is a partial cross-sectional view of the vacuum cleaner of FIG. 10 showing a state in which a dust separator is mounted thereon. FIG. 12 is a horizontal cross-sectional view of a dust storage device according to the embodiment of FIG. 10.

Referring to FIGS. 10 to 12, the vacuum cleaner according to this embodiment may include a main body 600 with a suction motor (not shown), a suction nozzle 820 rotatably connected to the main body 600, and a dust separator 700 that separate sucked dust and stores separated dust.

A mounting portion 630 configured to receive the dust separator 700 may be formed in the main body 600. The dust separator 700 may include a dust separation device 705 that separates dust and a dust storage device 800 that stores dust separated and discharged from the dust separation device 705.

The dust separation device 705 may separate dust from air by a cyclone flow, for example. The dust storage device 800 may be removably mounted on the main body 600. In a state in which the dust storage device 800 is mounted on the main body 600, an upper part of the dust storage device 800 may be coupled with a lower part of the dust separation device 705 by, for example, a locking device 900.

An air introduction portion 710, which may be in communication with the suction nozzle 620, may be formed on an upper part of the dust separation device 705. An air discharge portion 720, which may be in communication with the suction motor, may be formed at an upper portion of the dust separation device 705. A dust discharge portion 740, to which separated dust may be discharged, may be formed on the lower part of the dust separation device 705.

A first connection tube 640, which may be in communication with the suction nozzle 620, and a second connection tube 650, which may be in communication with the suction motor, may be provided in the main body 600. Ends of the connection tubes 640 and 650 may be disposed to face a front of the vacuum cleaner. In correspondence therewith, the introduction portion 710 and the air discharge portion 720 of the dust separation device 705 may be arranged and extend substantially in parallel toward at a rear side thereof. Therefore, the air introduction portion 710 and the air discharge portion 720 may be easily connected to the connection pipes 640 and 650 by a horizontal movement of the dust separation device 705.

An outside of the dust separation device 705 may be provided with a locking device 730. The locking device 730 may be rotatably connected to the dust separation device 705. The main body 630 may be provided with a connection device 660. When the locking device 730 rotates in a state in which the locking device 730 passes through or into the connection device 660, the dust separation device 705 may be fixed to the main body 600.

The dust storage device 800 may include a dust tank 810 that stores dust separated by the dust separation device 705, a compression member 820 that compresses dust flowing into the dust tank 810, and a drive device 825 that drives the compression member 820.

In more detail, an inside of the dust tank 810 may be provided with a partitioning device 811 that partitions an inner space of the dust tank 810 into a compression space 814, in which the compression member 820 may be positioned, and a storage space 815, in which the compressed dust may be stored. The compression space 814 may be defined between an inner surface of the partitioning device 811 and an inner peripheral surface of the dust tank 810. The storage space 815 may be defined between an outer surface of the partitioning device 811 and the inner peripheral surface of the dust tank 810. The partitioning device 811 may be provided with a communication hole 812 that communicates the compression space 814 with the storage space 815.

The compression member 820 may be rotatably disposed in the compression space 814. The compression member 820 may include a rotating shaft 821 and a blade 822. The blade 822 may be formed at an outer peripheral surface of the rotating shaft 442 and may be formed in a spiral shape. The rotating shaft 821 may be disposed inside the compression space 814 and may extend in a horizontal direction. The blade 822 may be designed to move dust inside the compression space 821 from one side to the other side when the rotating shaft 821 rotates in one direction.

Therefore, the compression member 820 may be rotatably operated, so that dust may be moved from one side to the other side by the rotation of the compression member 820, that is, in a horizontal direction. When the dust flowing into the compression space 814 is moved from one side to the other side, the dust may be compressed in a state in which it is collected onto a surface facing the communication hole 812 of the dust tank 810. The drive device 825 may be provided outside of the dust tank 810 and may be connected to the compression member 820 by a transfer device 826.

A part of the transfer device 826 may be inserted into the rotating shaft 821 of the compression member 820 by penetrating through the dust tank 810. The drive device 825 may be rotatably connected to the transfer device 826.

Figure 13:
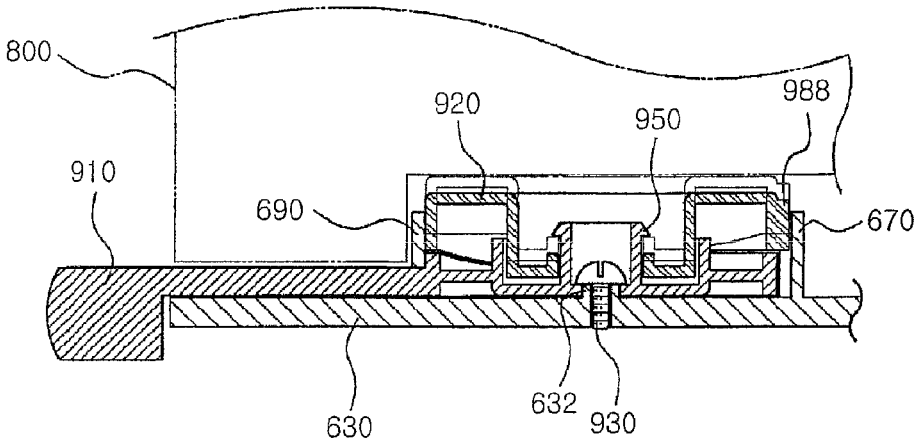
FIG. 13 is a vertical cross-sectional view of a locking device according to the embodiment of FIG. 10.
Figure 14:
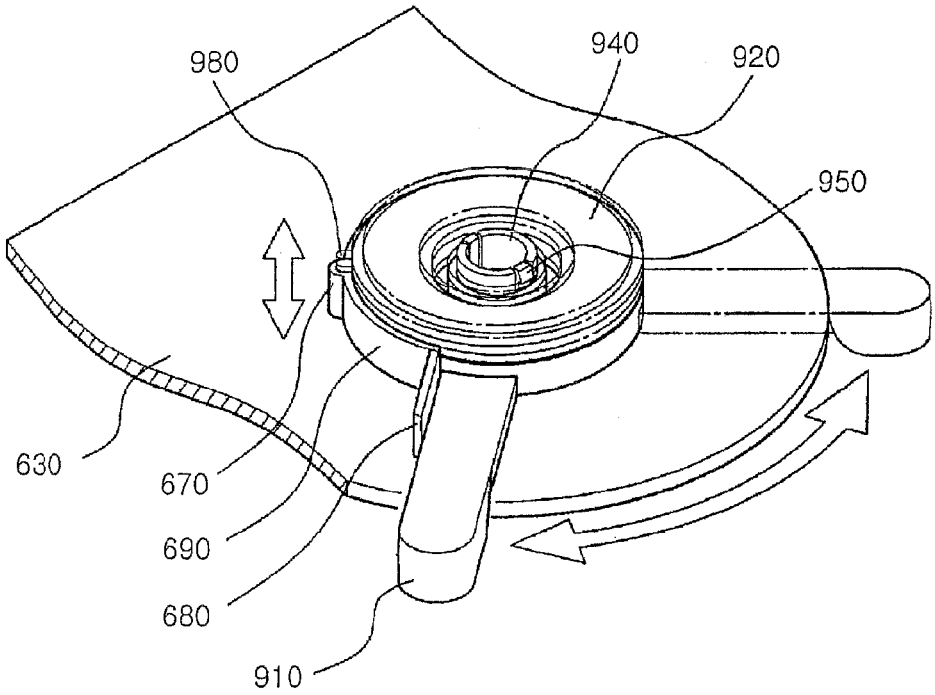
FIG. 14 is a perspective view of the locking device according to the embodiment of FIG. 10.
Figure 15:
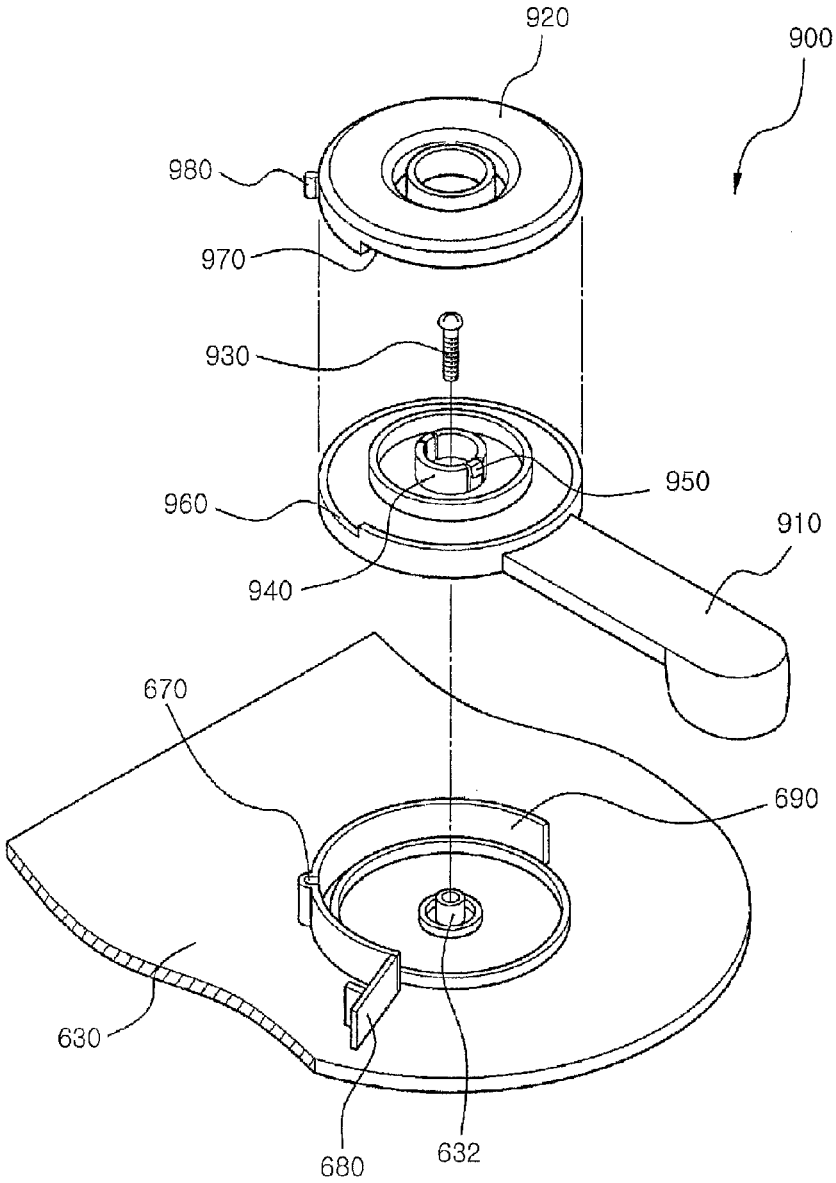
FIG. 15 is an exploded perspective view of the locking device according to the embodiment of FIG. 10.

FIG. 13 is a vertical cross-sectional view of a locking device according to the embodiment of FIG. 10. FIG. 14 is a perspective view of the locking device according to the embodiment of FIG. 10. FIG. 15 is an exploded perspective view of the locking device according to the embodiment of FIG. 10.

Referring to FIGS. 10 and 13 to 15, the locking device 900 may be provided below the mounting portion 630. The dust storage device 800 may vertically move while being housed in the mounting portion 630 by the locking device 900. In addition, in a state in which the dust storage device 800 moves upwards, the dust storage device 800 may be coupled to a lower part of the dust separation device 705. The locking device 900 may include an operation lever 910 and a locking disk 920. A hinge shaft 632 may be formed on the mounting portion 630. The operation lever 910 may be rotatably coupled to the hinge shaft 632 by, for example, a screw 930. A hollow hinge shaft 940 that protrudes upwards may be formed at a rotational center of the operation lever 910. The locking disk 920 may be coupled to the hinge shaft 940 to be vertically movable. In addition, a hook 950, which may be coupled with the locking disk 920, may be formed in or on the operation lever 910. A first cam portion 960 may be formed on an upper part of the operation lever 910 and a second cam portion 970 corresponding to the first cam portion 960 may be formed on a lower part of the locking disk 920. The locking disk 920 may move vertically on the hinge shaft 940 by interaction of the pair of cam portions 960 and 970. A protrusion 980 may be formed at one side of an outer peripheral surface of the locking disk 920 and a guide portion 670 that prevents rotation of the locking disk 920 by engaging with the protrusion 980 may be formed on the mounting portion 630. In addition, a stopper 680 that stops rotation of the operation lever 910 in one direction may be formed in or on the mounting portion 630.

As shown in FIG. 14, when the operation lever 910 rotates in a clockwise direction, the locking disk 920 may fall, such that the dust storage device 800 may be separated from the dust separation device 705. On the other hand, when the operation lever 910 rotates in a counter-clockwise direction, the locking disk 920 may rise, such that the dust storage device 800 may be coupled with the lower part of the dust separation device 705. In FIG. 14, reference numeral 690 represents a supporter that prevents the lower part of the dust storage device 800 from contacting with the locking device 900 by supporting the dust storage device 800 when the locking device 900 is unlocked (the dust tank is separated from the dust separation device).

According to this embodiment, when the dust separation device 705 is fixed to the main body 60, dust may be removed by separating the dust tank from the main body. Accordingly, a user may discharge dust from the dust storage device with little effort.

Figure 16:
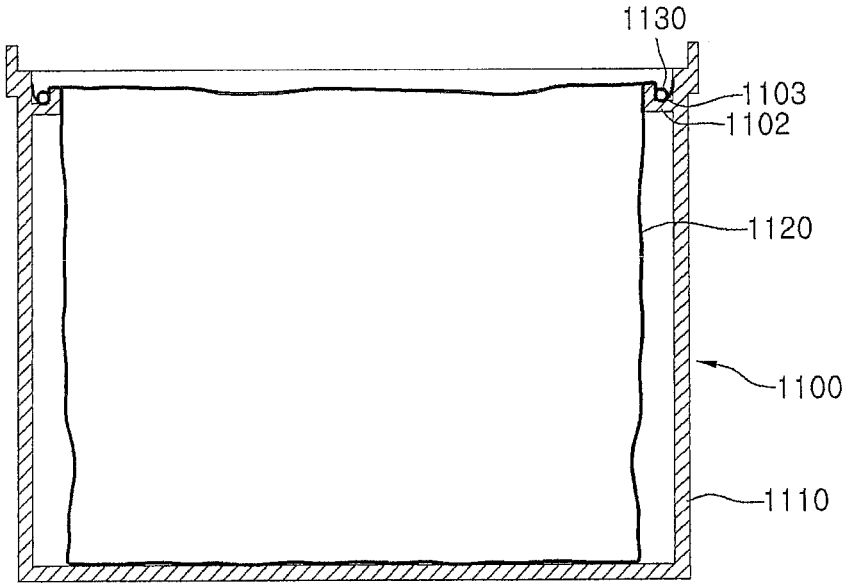
FIG. 16 is a vertical cross-sectional view of a dust storage device according to another embodiment.

FIG. 16 is a vertical cross-sectional view of a dust storage device according to another embodiment. This embodiment is the same as the embodiment of FIG. 1 except that an additional dust bag that stores dust may be provided in the dust storage device. Therefore, repetitive description has been omitted.

Referring to FIG. 16, the dust storage device 1100 according to this embodiment may include a dust tank 1110 having a space formed therein, a dust bag 1120 housed in the dust tank 1110 that stores dust discharged from the compression device, and a fixation device 1130 that fixes the dust bag 1120 to the dust tank 1110. More specifically, the dust bag 1130 may be, for example, paper or vinyl; however, embodiments are not limited thereto.

An upper portion of the dust tank 1110 may be open upwards. A coupling portion 1102 configured to be coupled with the fixation device 1130 may be formed on an inner peripheral surface of the dust tank 1110. The coupling portion 1102 may be continuously formed on the inner peripheral surface of the dust tank 1110 and may extend toward a center portion of the dust tank 1110 on the inner peripheral surface. The coupling portion 1102 may have a substantially "L"-shaped cross section in order to seat the fixation device 1130. Therefore, a seating portion 1103, on which the fixation device 1130 may be seated, may be formed in the coupling portion 1102.

The fixation device 1130 may be made of a material having an elastic force. For example, the fixation device 1130 may be made of a rubber material and may have a ring shape.

A peripheral length of the fixation device 1130 may be smaller than a peripheral length of the seating portion 1103 in order to increase a coupling force between the fixation device 1130 and the coupling portion 1102. As the fixation device 1130 is coupled with the coupling portion 1102, the coupling force between the fixation device 1130 and the coupling portion 1102 may increase.

An end portion of the dust bag 1130 may closely contact the coupling portion 1120 in order to fix the dust bag 1120 to the dust tank 1110. Thereafter, the fixation device 1130 may be coupled to the coupling portion 1102. Then, the dust bag 1120 may be fixed in the state in which an end portion of the dust bag 1120 may be positioned between the fixation device 1130 and the coupling portion 1102 by the elastic force of the fixation device 1130.

According to this embodiment, as compressed dust may be stored in the dust bag 1120 that is housed in the dust tank 1110, the dust bag 1120 may be removed and disposed of by separating only the dust bag 1120 from the dust tank 1110, thereby improving user convenience and preventing a user from getting dust on his or her hands. Further, as the dust tank 1110 may be prevented from being attached with dust, need for cleaning the dust tank 1110 may be reduced or removed.

Figure 17:
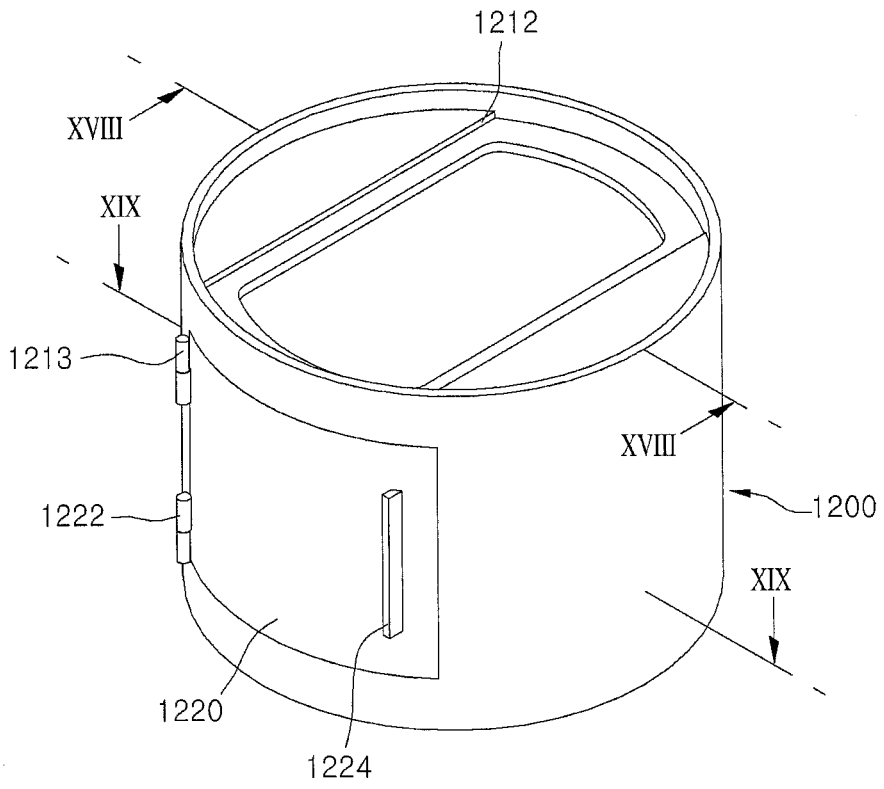
FIG. 17 is a perspective view of a dust storage device according to another embodiment.
Figure 18:
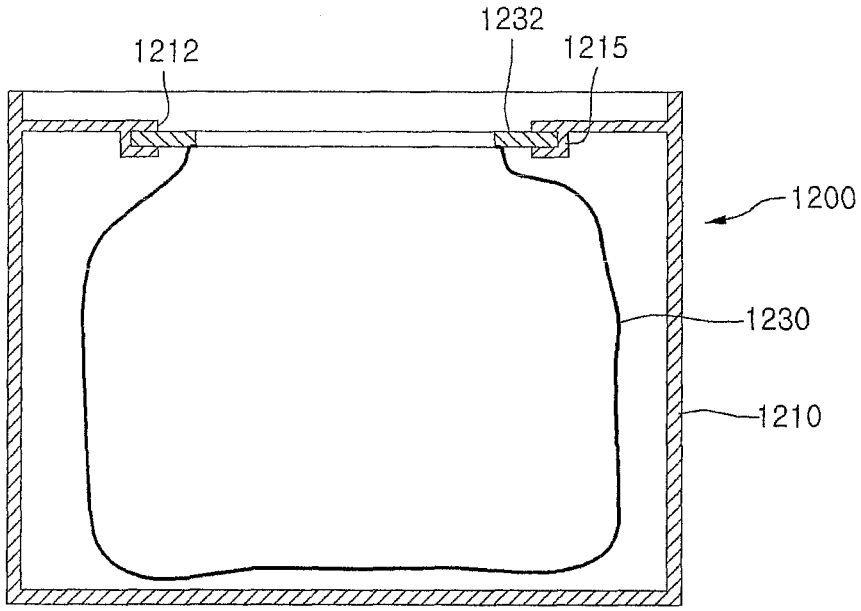
FIG. 18 is a cross-sectional view taken along line XVIII-XVIII of FIG. 17.
Figure 19:
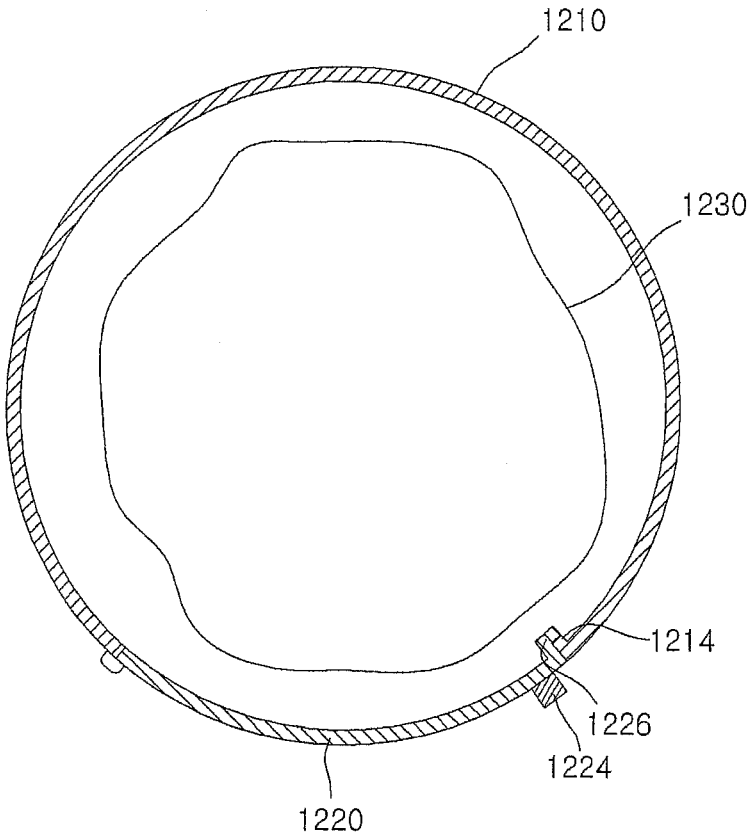
FIG. 19 is a cross-sectional view taken along line XIX-XIX of FIG. 17.
Figure 20:
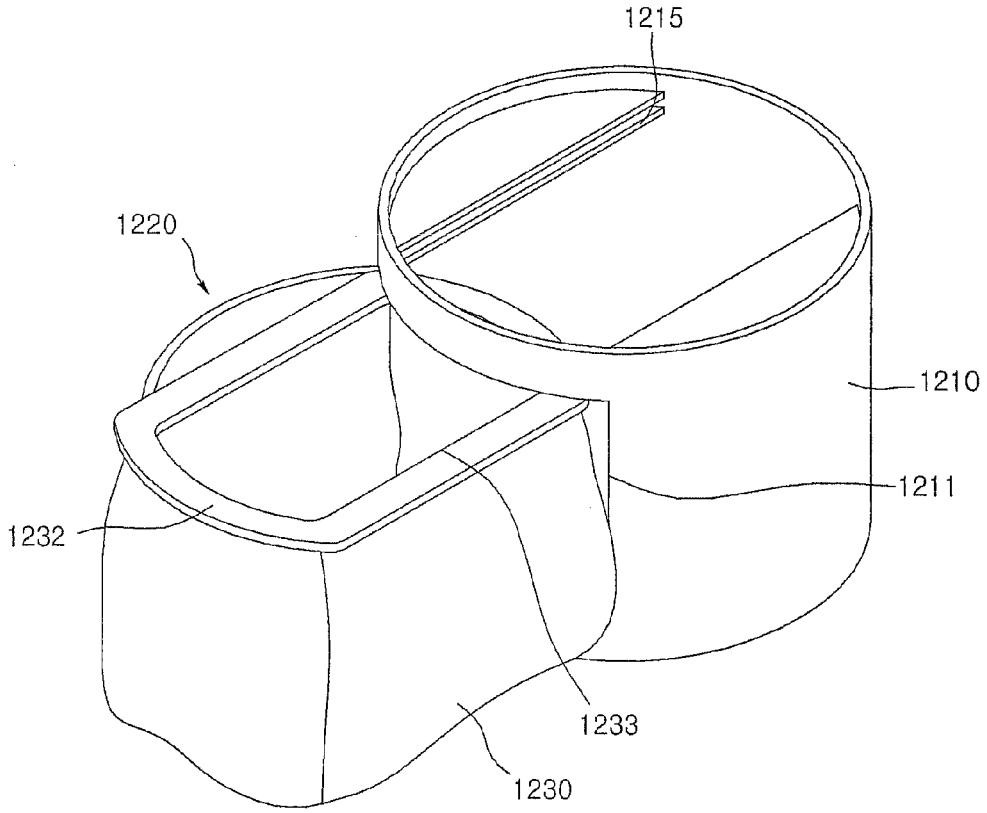
FIG. 20 is a diagram illustrating a state in which a dust bag is separated from a dust storage device according to the embodiment of FIG. 17.

FIG. 17 is a perspective view of a dust storage device according to another embodiment. FIG. 18 is a cross-sectional view taken along line XVIII-XVIII of FIG. 17. FIG. 19 is a cross-sectional view taken along line XIX-XIX of FIG. 17. FIG. 20 is a diagram showing a state in which the dust bag is separated from the dust storage device according to the embodiment of FIG. 17. This embodiment is the same as the embodiment of FIG. 1 except that an additional dust bag that stores dust may be provided in the dust tank. Therefore, repetitive disclosure has been omitted.

Referring to FIGS. 20 to 23, the dust storage device 1200 according to this embodiment may include a dust tank 1210 having a space formed therein and a dust bag 1230 that is housed in the dust tank 1210 to store dust compressed by the compression device.

More specifically, a dust introduction hole 1212, into which the compressed dust may be introduced, may be formed on an upper part of the dust tank 1210. In addition, an opening portion 1211 through which the dust bag 1230 may be drawn in and out, may be formed on a side wall of the dust wall 1210. Further, the opening portion 1211 may be opened and closed by a cover member 1220. One side of the cover member 1220 may be rotatably coupled to the dust tank 1210 by, for example, a hinge 1222. In addition, the other side the cover member 1220 may be selectively coupled to the dust tank by, for example, a hook 1226.

A hinge coupling portion 1213, to which the hinge 1222 may be coupled, may be formed on an outer peripheral surface of the dust tank 1210, and a hook engagement portion 1214, to which the hook 1226 may be engaged, may be formed on the inner peripheral surface of the dust tank 1210. In addition, a handle 1224 for a user's easy operation may be formed in the cover member 1220.

The dust bag 1230 may be, for example, paper or vinyl; however, embodiments are not limited thereto. An end portion of the dust bag 1230 may be coupled to a support portion 1232 that supports the dust bag while fixing the dust bag 1230 to the dust tank 1210.

A through-hole 1233, through which dust may pass, may be formed in the support portion 1232. The support portion 1232 may be drawn into the dust tank 1210 through the opening portion 1211 in a state in which the cover member 1220 may open the opening portion 1211. In addition, the support portion 1232 may be slidingly-coupled to the dust tank 1210, for example. For this, a coupling portion 1215 for being coupled with the support portion 1232 may be formed on the upper part of the dust tank 1210. The coupling portion 1215 may have, for example, an "L" shape. In addition, when the support portion 1232 is slidingly-coupled to the coupling portion 1215, the through-hole 1233 and the dust introduction hole 1212 may be aligned.

Referring to FIG. 20, the cover member 1220 may rotate in one direction with the handle 1224 of the cover member 1220 in order to replace the dust bag 1230. Then, the opening portion 1211 of the dust tank 1210 may be opened. Thereafter, when the support portion 1232 is pulled out of the dust tank 1210 by a user gripping the support portion 1232, the support portion 1232 may be slidingly-drawn out from the dust tank 1210 through the opening portion 1211.

The dust bag 1230 may be replaced even in a state in which the dust tank 1210 is mounted on the main body. Therefore, as the user may draw out the dust bag 1230 from the dust tank 1210 by opening the opening portion 1211 without removing the dust tank 1210 from the main body in order to replace the dust bag 1230, user convenience may be improved.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner, comprising:

a main body; and a dust separator mounted on the main body, wherein the dust separator comprises a dust separation device that separates dust in air and a dust storage device having at least one compression member disposed therein, the at least one compression member having a rotational shaft and a blade formed at an outer peripheral surface of the rotational shaft, wherein the dust storage device comprises a dust storage tank detachably mounted to the main body, the dust storage tank comprising a partitioning device that partitions the dust storage tank into a compression chamber, in which the at least one compression member is disposed, and a storage chamber, and wherein the partitioning device is provided with a communication hole that communicates the compression space with the storage space.

2. The vacuum cleaner of claim 1, wherein the compression chamber is defined between an inner surface of the partitioning device and an inner peripheral surface of the dust tank and wherein the storage chamber is defined between an outer surface of the partitioning device and the inner peripheral surface of the dust tank.

3. The vacuum cleaner of claim 1, wherein the blade has a spiral shape.

4. The vacuum cleaner of claim 1, wherein dust separated from the dust separation device is moved into the compression chamber.

5. The vacuum cleaner of claim 1, further comprising a drive provided outside the dust tank to drive the at least one compression member.

6. The vacuum cleaner of claim 5, further comprising a transferring device that connects the drive to the at least one compression member.

7. The vacuum cleaner of claim 6, wherein the drive is rotatably connected to the transferring device, and manipulated by a user.

8. The vacuum cleaner of claim 1, wherein the storage chamber surrounds the compression chamber.

* * * * *